US010323919B2

(12) United States Patent
Hash et al.

(10) Patent No.: US 10,323,919 B2
(45) Date of Patent: Jun. 18, 2019

(54) FRANGIBLE, CERAMIC-METAL COMPOSITE OBJECTS AND METHODS OF MAKING THE SAME

(75) Inventors: Mark C. Hash, Chelsea, MI (US); Trent Pearson, Saline, MI (US)

(73) Assignee: Ervin Industries, Inc., Ann Arbor, MI (US)

( * ) Notice: Subject to any disclaimer, the term of this patent is extended or adjusted under 35 U.S.C. 154(b) by 87 days.

(21) Appl. No.: 13/519,940

(22) PCT Filed: Jan. 6, 2011

(86) PCT No.: PCT/US2011/020329
§ 371 (c)(1),
(2), (4) Date: Jun. 29, 2012

(87) PCT Pub. No.: WO2011/085072
PCT Pub. Date: Jul. 14, 2011

(65) Prior Publication Data

US 2012/0279412 A1 Nov. 8, 2012

Related U.S. Application Data

(63) Continuation-in-part of application No. 12/683,156, filed on Jan. 6, 2010, now Pat. No. 8,028,626.
(Continued)

(51) Int. Cl.
*F42B 12/74* (2006.01)
*C22C 1/04* (2006.01)
(Continued)

(52) U.S. Cl.
CPC ..... *F42B 12/74* (2013.01); *C22C 1/04* (2013.01); *C22C 1/05* (2013.01); *F42B 8/14* (2013.01); *F42B 12/367* (2013.01); *F42B 30/02* (2013.01)

(58) Field of Classification Search
CPC ..... B22F 1/00; B22F 3/12; B22F 3/10; F42B 12/74
See application file for complete search history.

(56) References Cited

U.S. PATENT DOCUMENTS 2,976,598 A 3/1961 Creutz
3,718,441 A 2/1973 Landingham
(Continued)

FOREIGN PATENT DOCUMENTS

WO WO-9508653 A1 3/1995
WO WO-0003194 A2 1/2000
(Continued)

*Primary Examiner* — Aileen B Felton
(74) *Attorney, Agent, or Firm* — John G. Posa; Belzer PC

(57) ABSTRACT

In making frangible objects, including lead-free bullets and other projectiles, powdered metal primary and powdered ceramic secondary phases are mixed and densified at an elevated temperature such that the ceramic phase forms a brittle network. Different combinations of metal and ceramic phases may be used to achieve desired chemical and physical properties. Any appropriate mixing, forming, and/or thermal processing methods and equipment may be used. Degrees of frangibility, strength, and toughness can be adjusted to suit a given application by precursor selection, degree of mixing, relative amounts of metal and ceramic phases, forming method, and thermal and mechanical processing parameters.

20 Claims, 1 Drawing Sheet

Related U.S. Application Data

(60) Provisional application No. 61/391,791, filed on Oct. 11, 2010.

(51) Int. Cl.

| | |
|---|---|
| ***C22C 1/05*** | (2006.01) |
| ***F42B 8/14*** | (2006.01) |
| ***F42B 30/02*** | (2006.01) |
| ***F42B 12/36*** | (2006.01) |

(56) References Cited

U.S. PATENT DOCUMENTS

| | | | |
|---|---|---|---|
| 4,503,776 | A | 3/1985 | Nussbaum et al. |
| 4,703,696 | A | 11/1987 | Bocker |
| 4,939,996 | A | 7/1990 | Dinkha et al. |
| 5,078,054 | A | 1/1992 | Ashok et al. |
| 5,198,616 | A | 3/1993 | Anderson |
| 5,237,930 | A | 8/1993 | Belanger et al. |
| 5,261,941 | A | 11/1993 | Sheinberg |
| 5,399,187 | A | 3/1995 | Mravic et al. |
| 5,440,995 | A | 8/1995 | Levitt |
| 5,554,816 | A | 9/1996 | Skaggs et al. |
| 5,616,642 | A | 4/1997 | West et al. |
| 5,794,320 | A | 8/1998 | Wernz et al. |
| 5,814,759 | A | 9/1998 | Mravic et al. |
| 5,872,327 | A | 2/1999 | Taal et al. |
| 5,950,064 | A | 9/1999 | Robinson et al. |
| 6,048,379 | A | 4/2000 | Bray et al. |
| 6,074,454 | A | 6/2000 | Abrams et al. |
| 6,090,178 | A | 7/2000 | Benini |
| 6,158,351 | A | 12/2000 | Mravic et al. |
| 6,186,072 | B1 | 2/2001 | Hickerson, Jr. et al. |
| 6,263,798 | B1 | 7/2001 | Benini |
| 6,374,743 | B1 | 4/2002 | Hug et al. |
| 6,457,147 | B1 | 9/2002 | Williams |
| 6,789,484 | B2 | 9/2004 | Kellner |
| 6,916,354 | B2 | 7/2005 | Elliott |
| 7,217,389 | B2 | 5/2007 | Amick |
| 7,226,492 | B2 | 6/2007 | Mahot et al. |
| 7,231,876 | B2 | 6/2007 | Kellner |
| 7,353,756 | B2 | 4/2008 | LeaSure |
| 2010/0083861 | A1 | 4/2010 | Joys et al. |

FOREIGN PATENT DOCUMENTS

| | | | | |
|---|---|---|---|---|
| WO | WO-03033753 | A2 | 4/2003 | |
| WO | WO-06137816 | A2 | 12/2006 | |
| WO | WO-07022838 | A1 | 3/2007 | |
| WO | WO-07086852 | A2 | 8/2007 | |
| WO | WO2007086852 | * | 8/2007 | ..... B22F 1/00 |

* cited by examiner

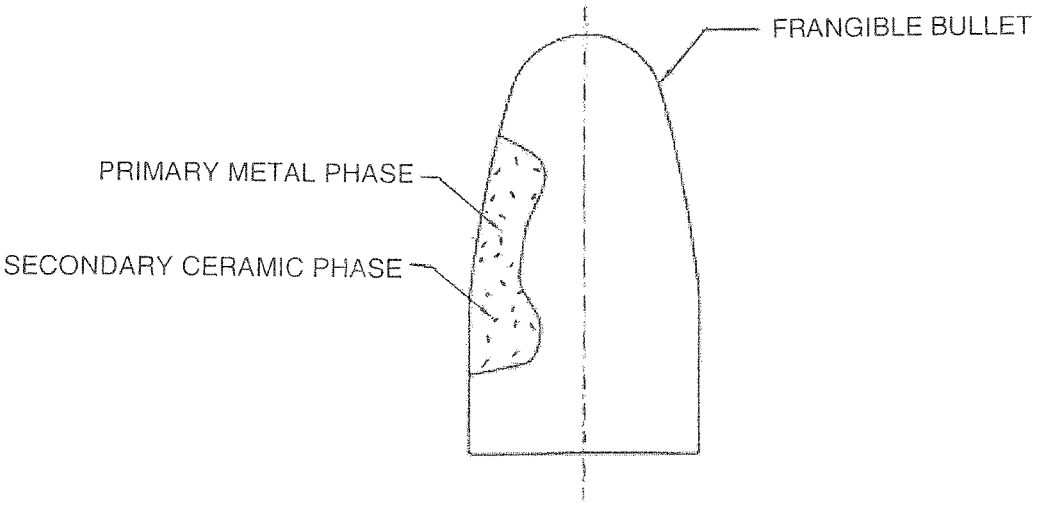
FRANGIBLE BULLET
PRIMARY METAL PHASE
SECONDARY CERAMIC PHASE

FRANGIBLE, CERAMIC-METAL COMPOSITE OBJECTS AND METHODS OF MAKING THE SAME

REFERENCE TO RELATED APPLICATIONS

This application is a continuation-in-part of U.S. patent application Ser. No. 12/683,156 filed Jan. 6, 2010. This application also claims priority to U.S. Provisional Patent Application Ser. No. 61/391,791 filed filed Oct. 11, 2010. The contents of both are incorporated herein by reference.

FIELD OF THE INVENTION

This invention relates generally to frangible components and, in particular, to ceramic-metal frangible projectiles and related manufacturing methods.

BACKGROUND OF THE INVENTION

A material is said to be frangible if it tends to break up into fragments rather than deforming plastically and retaining its cohesion as a single object. Frangible bullets are designed to intentionally disintegrate into particles upon impact with a surface harder than the bullet itself. Uses include firing range safety, to limit environmental impact, or to limit the danger behind an intended target. For example, frangible bullets are often used by shooters engaging in close-quarter practice or combat training to avoid ricochets. Frangible bullets are typically made of non-toxic metals, and are frequently used on "green" ranges and outdoor ranges where lead abatement is a concern.

An early example of a frangible bullet is the Glaser safety slug, which was originally a hand-made hollow point bullet filled with birdshot and covered with a flat polymer cap. To improve ballistic performance, a polymer-tipped round ball was introduced in 1987, and the current compressed core form was first sold in 1988. The formulation of the polymer was also changed in 1994 to improve fragmentation reliability. Compared to conventional ammunition, the rounds are said to be very expensive and less accurate.

Over the years, numerous alternative frangible bullet designs have emerged, some of which have become commercially available. SinterFire Inc. of Kersey, Pa., for example, owner of U.S. Pat. No. 6,263,798, manufactures and sells frangible bullets based upon a mixture of copper, tin and a metal or metalloid binder material which is compacted into a desired shape then heated and cooled.

Another example is AccuTec USA of Virginia Beach, Va., which markets and sells a frangible projectile purportedly having a specific gravity similar to that of lead. According to its U.S. Pat. No. 7,353,756, projectile comprises, by weight, 6-66% ballast and 34-94% polyether block amide resin binder. The ballast comprises at least one member selected from a group consisting of tungsten, tungsten carbide, molybdenum, tantalum, ferro-tungsten, copper, bismuth, iron, steel, brass, aluminum bronze, beryllium copper, tin, aluminum, titanium, zinc, nickel silver alloy, cupronickel and nickel.

While some frangible bullet designs utilize non-metallic or polymeric binders, others use ceramic materials. As one example, U.S. Pat. No. 5,078,054 teaches a frangible projectile made from powdered metals comprising a body of either iron and carbon, or of iron and alumina. The powdered metals are compacted, sintered, and cooled. A further example is disclosed by Abrams et al., U.S. Pat. No. 6,074,454, assigned to Delta Frangible Ammunition, LLC of Stafford, Va. The bullets in this case are typically made from copper or copper alloy powders (including brass, bronze and dispersion strengthened copper) which are pressed and then sintered under conditions so as to obtain bullets with the desired level of frangibility. The bullets also contain several additives that increase or decrease their frangibility. Such additives may include oxides, solid lubricants such as graphite, nitrides such as BN, SiN, AlN, etc., carbides such as WC, SiC, TiC, NbC, etc., and borides such as $TiB_2$, $ZrB_2$, $CaB_6$.

SUMMARY OF THE INVENTION

This invention resides in methods of producing frangible objects, and the objects which result, these including frangible lead-free bullets, bullet cores, and other projectiles. A method of producing a frangible object according to the invention includes the steps of providing a powdered metal primary phase and a powdered ceramic secondary phase. In the preferred embodiment the powders are mixed and densified at an elevated temperature such that the ceramic phase forms a brittle network.

A method of producing a frangible object in accordance with the invention comprises the steps of providing a ductile metal or metal alloy and a ceramic, both in powdered form. Such powders are then mixed and densified in a form to produce an object having a desired, predetermined shape. To produce ammunition, the desired, predetermined shape is a bullet or a bullet core, the latter being defined as a central mass with is partially or fully jacketed.

The ceramic powder may be composed of a crystalline or amorphous material. In the preferred embodiment, the ceramic powder is a silica-based glass powder, and the metal or metal alloy is composed of copper, iron or a mixture thereof. Alternatively, the metal or metal alloy may be composed of zinc, iron, or a mixture thereof, or more massive elements such as depleted uranium.

The powders may be intimately and mechanically mixed, compressed into a net-shape form, and sintered. The invention is not limited to these constituents or steps, however, since frangible objects may be made from different combinations of metal and ceramic phases able to achieve desired chemical and physical properties such as bulk density and levels of frangibility, strength, and toughness for a particular application. Lead-free and/or non-toxic parts, for instance, would therefore exclude use of any lead-containing or toxic raw materials. Any appropriate mixing, forming, and/or thermal processing methods and equipment may be used.

Bulk density can be adjusted by use of select precursors and level of densification achieved either mechanically and/or thermally. Mechanical treatments include forming and potentially hot or cold working after thermal processing. Thermal treatments include densification/sintering and potentially post-densification annealing; to relieve or even enhance residual stresses within the parts.

BRIEF DESCRIPTION OF THE DRAWINGS

FIG. 1 is a simplified, cross-sectional drawing that illustrates a preferred embodiment of the invention.

DETAILED DESCRIPTION OF THE INVENTION

In accordance with the invention, an intimate, mechanical mixture of metal and ceramic powders is uniaxially pressed into a form or green-body, such as a bullet, and then sintered to produce a frangible part suitable for use as ammunition or in other applications requiring comparable physical properties; balanced levels of strength, toughness, and ductility. The mechanical mixing and thermal processing is designed to yield a microstructure composed of metal and ceramic phases distributed appropriately to yield the desired properties. These processing steps can be adjusted to suit the desired combination of powders and physical property ranges. Conversely, the powders can also be chosen selectively to govern attributes of these parts.

The primary metal phase for lead-free, frangible bullets is copper due to its theoretical density and relatively low cost in comparison to other high-density elements. A low-cost, silica-based glass is then intimately, mechanically mixed with the copper powder. Note that the use of the term "ceramic" is intended to encompass both crystalline and amorphous (or glass) materials. Parts are pressed at a relatively low pressure, ~0,000 psi, and then sintered under a protective, gas atmosphere (nitrogen, argon, or helium for example) during which both the metal and ceramic components sinter together to form a strong, yet frangible, net-shape bullet. Pressures in excess of 10,000 psi may also be used. The inclusion of the ceramic phase, in this example a glass, results in a part that behaves in a brittle manner under dynamic or kinetic loads. The semi-continuous matrix of copper provides needed strength and toughness to be manufactured and operated as ammunition.

This approach of producing frangible components in accordance with the invention may be adjusted in terms of the combination of elements; including alloys and compounds thereof, to suit different applications relative to cost, availability, toxicity, etc. The inclusion of a well-distributed, relatively fine, brittle phase or phases [as compared to the matrix phase(s)], is the primary factor affecting the part's frangibility. Accordingly, proper choice of precursor particle size distributions and degree of mixing may be critical. Mixing and potentially milling of metal and ceramic components can be accomplished using any method capable of providing a homogenous powder blend. Not only can essentially any combination of metal and ceramic phases be employed, but any suitable forming method can also be used assuming target levels of final density can be achieved via sintering from a given green density.

The sintering, or thermally-induced densification, can occur in all of the phases or just the binder phase. As such, in accordance with this description, sintering should be taken to include softening or melting sufficient to form a sub-matrix with the other particles present to form consolidated mass. It is believed that metal-ceramic combinations, especially at low volume percentages of the ceramic material(s), which are heated such that only the metal phase(s) is able to sinter, will result in minimal frangibility. Accordingly, the mix of powders should be designed such that ceramic phase(s) can be sintered to form a brittle network. The metal phase can be co-sintered or merely bound together by the ceramic phase; that is, the sintering temperature of the ceramic phase(s) should be at or below that of the metal phase(s). The development work described in the experimental section of this report illustrates these possible designs.

EXAMPLES

Fine powder mixtures were prepared by hand in an alumina mortar and pestle containing either copper or iron with one of two, silica-based, commercially-available glass powders. Powders used were all less than 100 microns in average diameter, produced by either crushing or atomization. The copper powder purchased from Corbin (White City, Oreg.) primarily used in our experiments was measured per ASTM B-821 and ASTM B-822 with results of all pass 104 micron with a D50 of 38 microns. The glass powder was purchased from Elan Technology (Macon, Ga.). The glass products investigated were Elan part numbers 13 and 88. The particle size of these glass powders are predominantly below 44 micron.

Relative amounts of copper or iron and glass were varied ranging from 5 to 20 wt % ceramic with the balance being metal. The powders were ground together until the mixture appeared homogenous at which time a small amount, 1-2 ml, of glycerin was added to enhance green body strength. Approximately 1" diameter pellets were uniaxially pressed at 10-12 ksi to form test parts. These were then sintered in an inert atmosphere using an array of sintering profiles in which heating and cooling rates, intermediate and maximum temperatures, and hold times at these temperatures were varied to define suitable heating schedules. Hold times ranged from 4 to 16 hours at max temp. The maximum temperatures investigated were 1200-1700 F.

Once cooled to room temperature pellets were characterized in terms of bulk density, strength, toughness, and uniformity. Density was determined using helium pycnometry whereas strength, toughness, and uniformity were accessed qualitatively for these scoping studies.

Results and Discussion:

Parts made thus far were compared to commercially-available copper-based, frangible bullets that employ brittle metallic phases to achieve desired properties. The final physical properties of these two materials are essentially identical. The ceramic-metal composite approach is believed to be more economical via the use of lower cost binders, for instance glass versus tin, while providing material engineering flexibility since a large variety of constituents can be employed.

The materials engineering potential of this approach is substantial since physical attributes of the parts can be varied not only by material choices but also processing parameters. The following list of factors can affect final properties of these ceramic-metal composites. Accordingly they can all be adjusted to produce parts with widely varying physical properties as needed by a given application.

Metal powder(s), chemistry and shape;
Ceramic powder(s), chemistry and shape;
Degree of mixing/distribution of components;
Forming pressure and method;
Sintering profile (time and temperature schedule);
Thermal and mechanical treatments; annealing, working.

The technology described herein can be applied to many applications. Two specific examples are bullets and bullet cores. Metallic phases of interest also include elemental iron, zinc, tin, copper, and uranium ("depleted"). Also, physical and chemical mixtures of these metals can yield desirable properties. For instance, a physical mixture of copper and zinc or a chemical combination or alloy of these metals, commonly known as brasses, can be used in combination with glass phase to provide the desired strength, toughness, and frangibility. Specific examples of potential phase assemblages are as follows.

Copper-Glass; a "baseline" configuration providing the density, toughness, and strength of copper and the brittleness of glass.

Iron-Glass; as compared to the baseline, less dense but notably more economical due to relative cost of iron versus copper.

Copper-Iron-Glass; an intermediate of the above two configurations designed to provide the best possible combination of physical and economical attributes.

Zinc-Glass, Iron-Zinc-Glass, or an Alloy of Iron and Zinc-Glass; again utilizing low cost, dense metal phases in the composite's design. Copper could be added as well to enhance bulk density of the composite if desired for a given application such as frangible bullets.

Depleted uranium (DU)-Glass; a military ballistic application designed to provide a unique combination of penetration and frangibility capabilities.

Employing different metals, alloys, and combinations thereof provide a wide variety of material designs that can achieve target performance and commercial levels. The basic principle of the invention remains the mixture and balance of competing physical properties associated with, in general, ductile metals and brittle ceramics, obtained by proper design and processing.

The invention claimed is:

1. A method of producing a frangible object, comprising the steps of:

providing a ductile metal or metal alloy in powdered form;

providing a ceramic powder;

mixing the metal and ceramic powders;

densifying the mixture in a form to produce an object having a desired, predetermined shape; and wherein the step of densifying the mixture is carried out at an elevated temperature such that the ceramic powder forms a brittle network.

2. The method of claim 1, wherein the desired, predetermined shape is a bullet or a bullet core.

3. The method of claim 1, wherein the ceramic powder 1s a silica-based glass powder.

4. The method of claim 1, wherein the ceramic powder is composed of a crystalline or amorphous material.

5. The method of claim 1, wherein the metal or metal alloy is composed of copper, iron or a mixture thereof.

6. The method of claim 1, wherein the metal or metal alloy is composed of zinc, iron or a mixture thereof.

7. The method of claim 1, wherein the metal or metal alloy includes depleted uranium.

8. The method of claim 1, wherein the step of densifying the mixture includes compressing and sintering the mixture.

9. The method of claim 8, wherein the sintering temperature of the ceramic powder is at or below the sintering temperature of the metal powder.

10. The method of claim 8, wherein the metal powder is co-sintered with the ceramic powder.

11. The method of claim 8, wherein the sintering causes the metal powder to be bound together by the ceramic powder.

12. The method of claim 8, wherein the pressurizing and sintering is carried out in an inert atmosphere.

13. The method of claim 1, wherein the step of densifying the mixture includes uniaxially pressing the mixture into the form or a green-body.

14. The method of claim 1, wherein the step of densifying the mixture includes uniaxially pressing the mixture into a form shaped like a bullet or a bullet core.

15. The method of claim 1, wherein the step of densifying the mixture includes pressurization of 10,000 psi or greater.

16. The method of claim 1, wherein the mixture is lead-free.

17. The method of claim 1, wherein one or both of the powders are milled.

18. The method of claim 1, further including the step of adjusting bulk density through mechanical or chemical treatments.

19. The method of claim 1, further including the step of hot or cold working the shape following densification.

20. The method of claim 1, further including the step of post-densification annealing to relieve or enhance residual stresses within the object.

* * * * *